US006546923B2

(12) United States Patent
Erickson

(10) Patent No.: US 6,546,923 B2
(45) Date of Patent: Apr. 15, 2003

(54) BALL LAUNCHING APPARATUS

(76) Inventor: Erven D. Erickson, 1748 Hutchison Rd., Addy, WA (US) 99101

( * ) Notice: Subject to any disclaimer, the term of this patent is extended or adjusted under 35 U.S.C. 154(b) by 0 days.

(21) Appl. No.: 09/872,847

(22) Filed: May 31, 2001

(65) Prior Publication Data

US 2002/0179073 A1 Dec. 5, 2002

(51) Int. Cl.[7] ..... F42B 3/03
(52) U.S. Cl. ..... 124/16; 124/7; 124/17; 124/36
(58) Field of Search ..... 124/7, 16, 17, 124/36

(56) References Cited

U.S. PATENT DOCUMENTS

| | | | | |
|---|---|---|---|---|
| 202,301 A | | 4/1878 | Taltavull | |
| 2,080,958 A | | 5/1937 | Beasley et al. | |
| 3,128,752 A | | 4/1964 | Andersen | |
| 4,254,755 A | | 3/1981 | Morgan et al. | |
| 4,714,069 A | | 12/1987 | Ulrich | |
| 4,860,717 A | | 8/1989 | Powell et al. | |
| 5,415,150 A | | 5/1995 | Dallas | |
| 5,575,482 A | | 11/1996 | Butler, Jr. | |
| 5,619,977 A | | 4/1997 | Gatin | |
| 5,911,214 A | | 6/1999 | Andrews | |
| 5,975,527 A | * | 11/1999 | Winchester | 124/7 X |
| 6,019,096 A | * | 2/2000 | Snyder et al. | 124/16 |
| 6,220,236 B1 | * | 4/2001 | Dillard | 124/16 |

* cited by examiner

*Primary Examiner*—John A. Ricci
(74) *Attorney, Agent, or Firm*—Wells St. John P. S.

(57) ABSTRACT

A ball launching apparatus is described in which a main frame mounts a ball support sub-frame for adjustable positioning about an axis. A ball carrier is provided on the ball support sub-frame at a radial distance from the adjustment axis. A ball striker arm with a striker pad is mounted for pivotal motion about the axis and moves in a swing path intersecting the ball carrier.

27 Claims, 7 Drawing Sheets

Fig 7
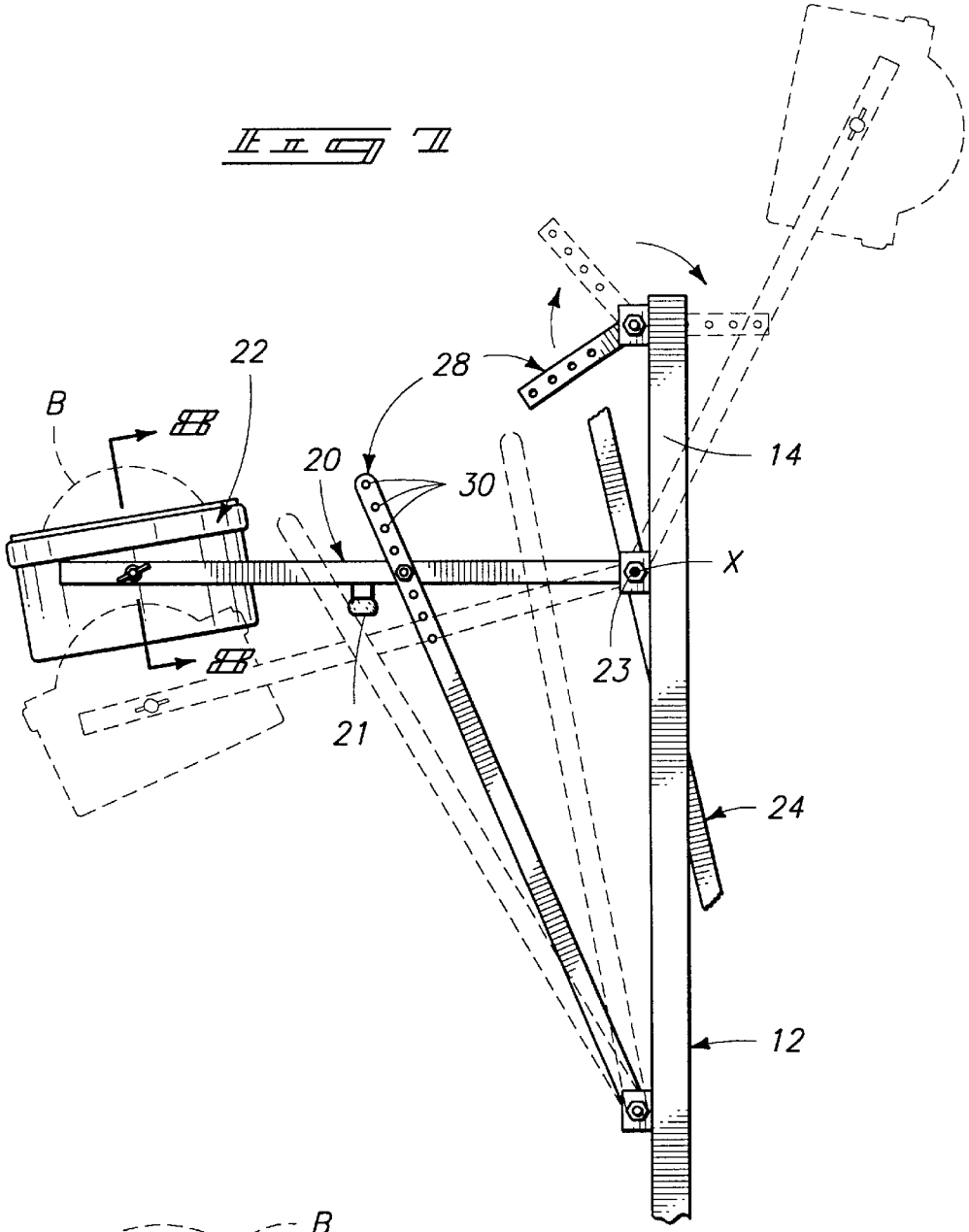
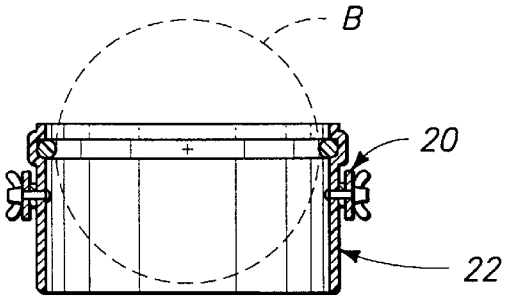
Fig 8

BALL LAUNCHING APPARATUS

TECHNICAL FIELD

The present invention relates to practice devices for launching a game ball to a player.

BACKGROUND OF THE INVENTION

Games involving a game ball require extensive practice before proper ball handling is mastered. In the example of volleyball and in a particular example, say practice for spiking the ball, a player usually must rely on another player or a coach to repeatedly "set" the ball. "Setting" the ball is a practice in which the ball is launched into an upward arc above the net. The player then jumps and "spikes" the ball, striking it forcefully downward over the net. Setting the ball is a tedious task, and takes time away from other practice activities for the "setter". A player can set the ball for herself, by tossing the ball into the air, then spiking it over the net. However, self setting is not preferred since the trajectory of a self set ball is seldom similar to ball trajectory in actual game conditions. That is, the ball is always set by another player in game conditions and is almost always set from a position remote from the location of the spiker.

The above is an example of a single practice situation in which two players or participants are typically involved for the training benefit of only one. Similar situations may be recognized in other sports such as soccer or basketball.

In response to the above problem, machines have been developed specifically for launching balls to a player for practice purposes. Such machines are often powered by electric motors, are bulky, and are very expensive.

A need has thus remained for a training device that is portable, versatile, simple to operate, and inexpensive.

BRIEF DESCRIPTION OF THE DRAWINGS

Preferred embodiments of the invention are described below with reference to the following accompanying drawings.

FIG. 7 is a view illustrating various adjusted angles for the ball holder and release positions, with some positions being shown by dashed lines.

FIG. 8 is a sectional view through the ball support and adjusting mechanism.

DESCRIPTION OF EXEMPLARY EMBODIMENTS

Figure 1:
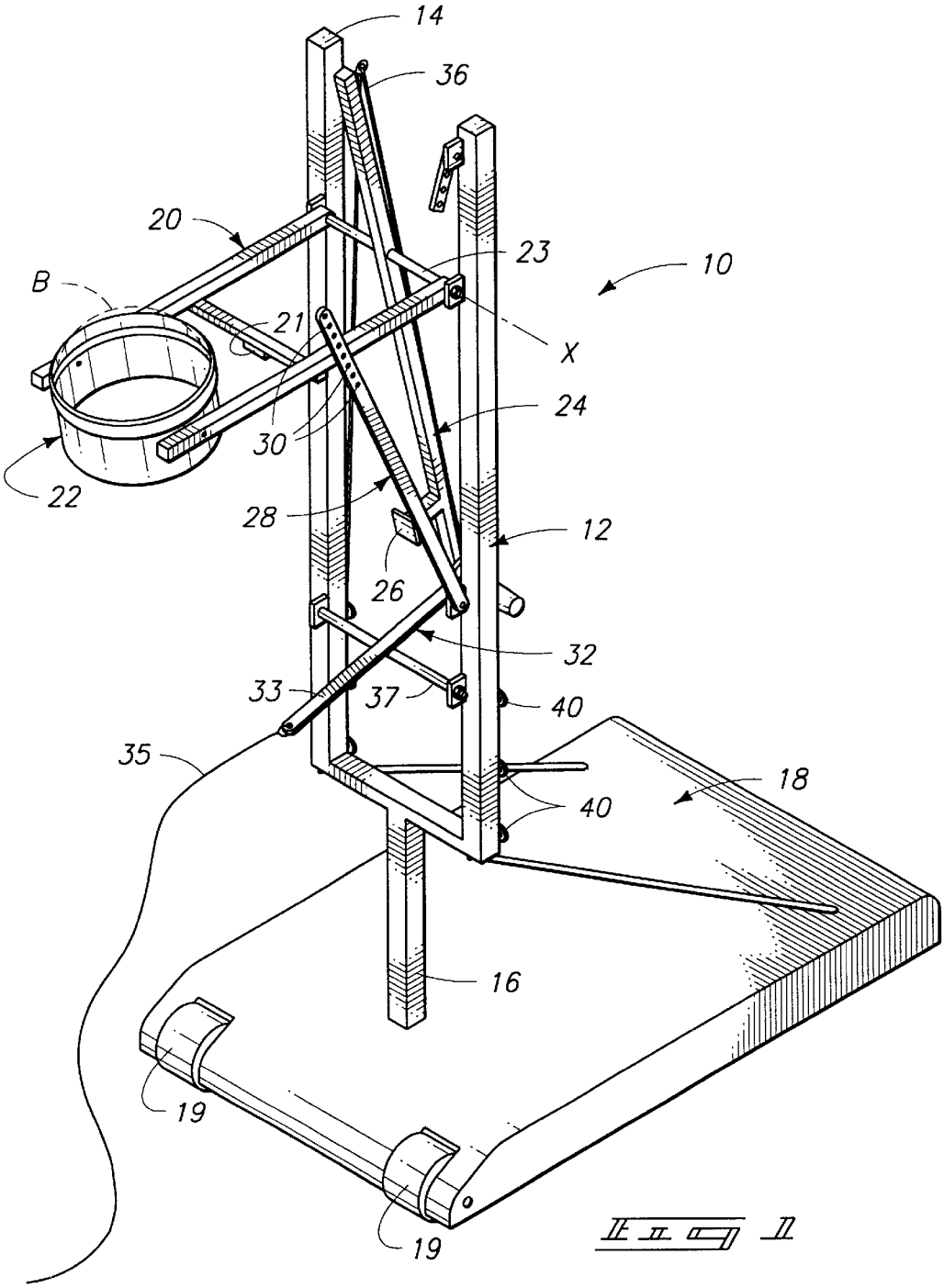
FIG. 1 is a perspective view of a ball setting machine showing by way of example, a first preferred form of the invention.
Figure 2:
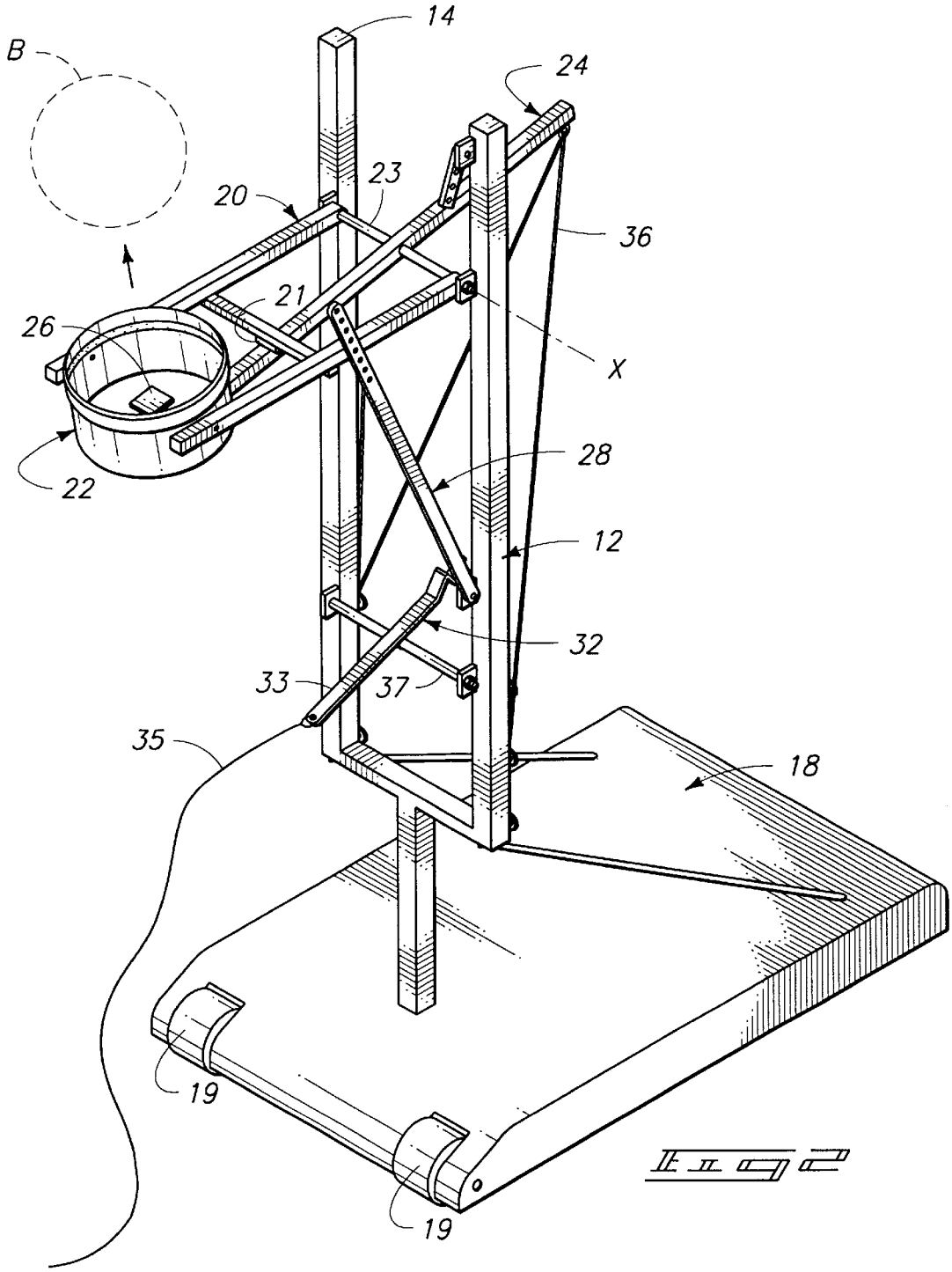
FIG. 2 is a view similar to FIG. 1 only showing the ball in dashed lines being launched from the device.
Figure 3:
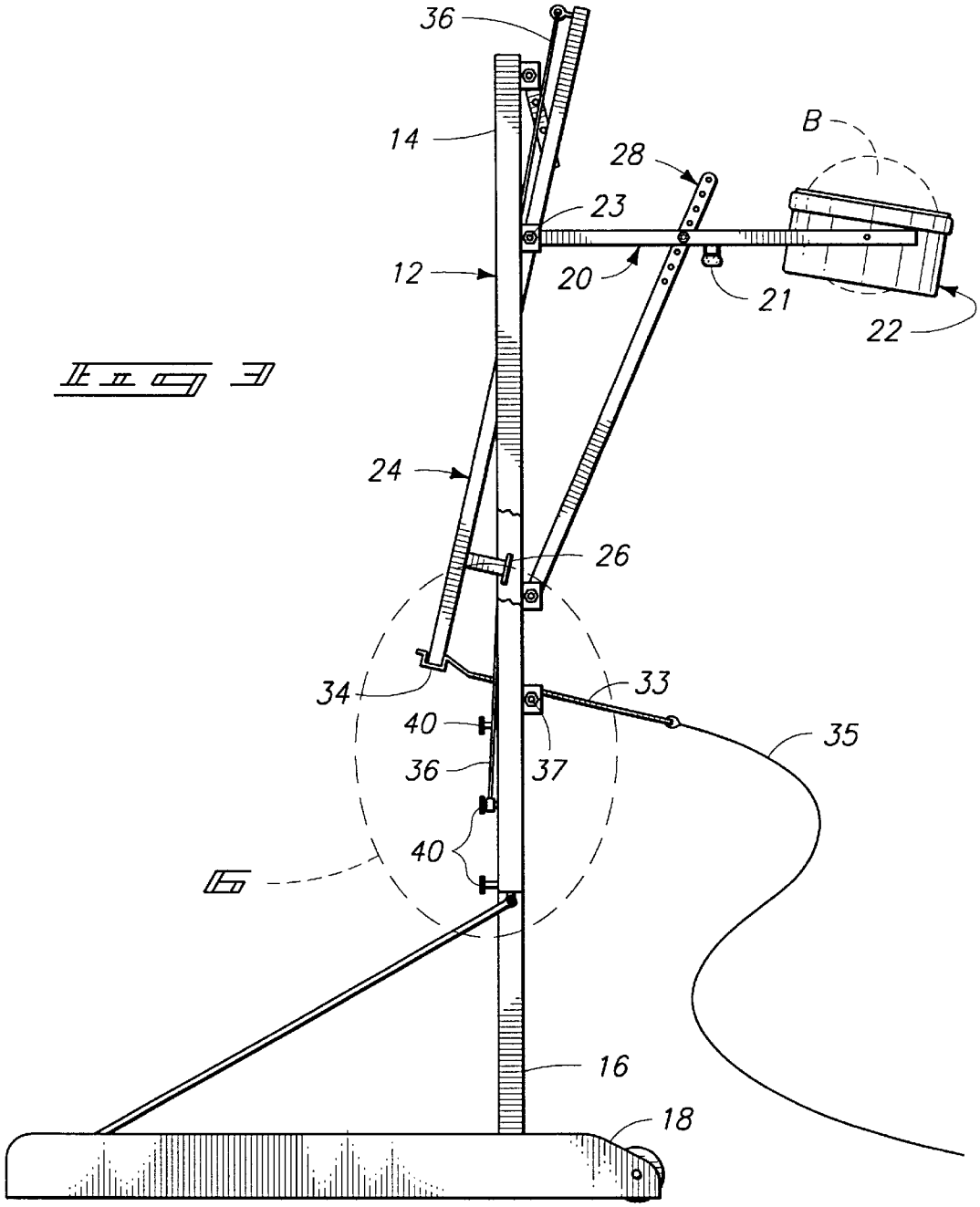
FIG. 3 is a view of the device in a drawn and ready to launch condition.
Figure 4:
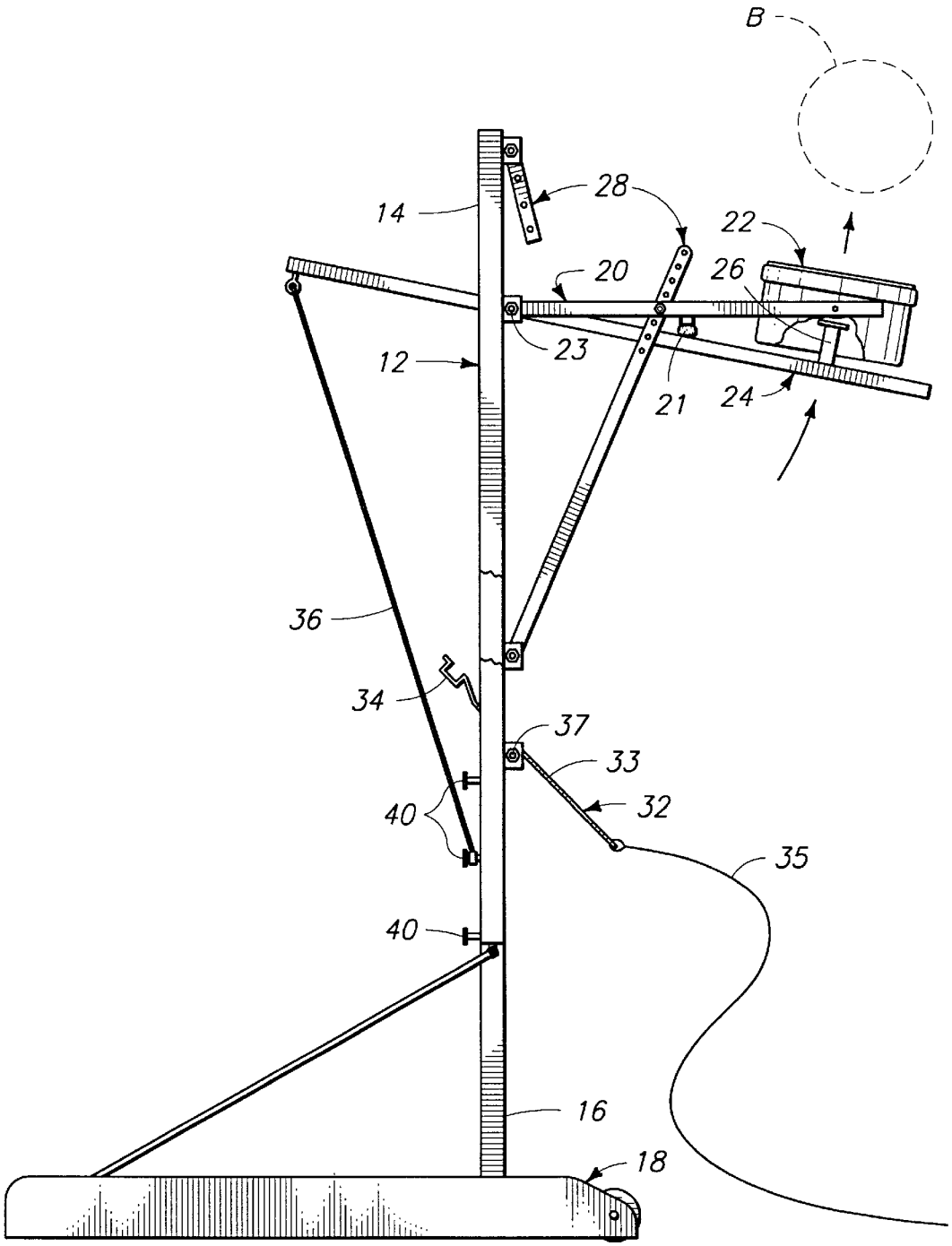
FIG. 4 is a side elevation view of the device in the launching mode.

This disclosure of the invention is submitted in furtherance of the constitutional purposes of the U.S. Patent Laws "to promote the progress of science and useful arts" (Article 1, Section 8).

Before entering into a detailed discussion and description of exemplary features, descriptions will be made of basic aspects of the invention in general terms.

General Description

In one aspect of the invention, a ball launching apparatus 10 is provided, comprising a main frame 12 with a top end 14 and a bottom end 16. A base support 18 is provided at the bottom end 16, supporting the main frame 12. A ball support sub-frame 20 is mounted to the main frame 12 for adjustable positioning about an axis X. A ball carrier 22 on the ball support sub-frame 20 is positioned thereon at a radial distance from the adjustment axis X. A ball striker arm 24 is mounted for pivotal motion about the axis X and is movable in a swing path intersecting with the ball carrier 22. A ball striker pad 26 is mounted to the ball striker arm 24.

In another aspect, a ball launching apparatus 10 is comprised of, an elongated main frame 12 including a top end 14 and a bottom end 16. A base support 18 on the bottom end 16 of the frame supports the main frame in a substantially upright orientation. A ball support sub-frame 20 is mounted to the main frame 12 adjacent the top end 14 for adjustable positioning about a substantially horizontal axis X. A ball support sub-frame angle adjuster 28 is mounted between the main frame 12 and ball support sub-frame 20, with adjustable positioning stops 30 at selected positions about the axis X. A ball carrier 22 is provided on the ball support sub-frame positioned thereon at a radial distance from the axis and shaped to releasably grip a game ball B. A ball striker arm 24 is mounted for pivotal motion coaxially with the ball support sub-frame 20 and is movable in a swing path intersecting with the ball carrier 22. A ball striker pad 26 is provided on the ball striker arm 24. A lanyard release 32 is mounted to the main frame 12 and is releasably engageable with the ball striker arm 24 to permit remote release of the ball striker arm 24. A biasing means 36 is connected between the main frame 12 and ball striker arm 24 for producing a selective swing force in the ball striker arm about the axis X toward the ball carrier 22.

Detailed Description

Preferred examples of components are illustrated in the accompanying drawings, and while these components are preferred as shown and described, it should be understood that equivalent components which may or may not be shown, may also be usable in conjunction with the apparatus without departing from the scope of my invention.

Keeping the above in mind, attention is firstly drawn to FIG. 1.

The mainframe 12 may be formed of rigid tubular members welded or otherwise secured together. The frame 12 is shown in a "Y" configuration with the ball support sub-frame 20 situated adjacent to the top end 14. The vertical members of the Y configuration are useful in providing opposed vertical supports for opposite ends of the pivoted sub-frame 20 and for the ball striker arm 24.

The main frame 12 may be releasably mounted to the base support 18 and may also be braced by appropriate struts as shown substantially in FIGS. 1–4. The base support 18 may be of a relatively conventional form, typically such forms are a hollow plastic structure that may be filled with water or sand to provide weight and mass. Wheels 19 can be provided at one end of the base support to facilitate adjustments and movement of the apparatus and relatively flat surfaces. Of course other forms of base supports may be used, or the base support may be considered a permanent structure such as a floor or ground surface. Thus, the term "base support" should be considered to have a broad meaning.

The ball support sub-frame 20 may also be formed of rigid metal members such as tubular aluminum or steel. In the illustrated form, the sub-frame 20 is substantially "H" shaped, with a cross member joining two opposed arm members. A stop or pad 21 may be provided on the cross member in the swing path of the ball striker arm 24 to engage and stop the swinging motion of the ball striker arm 24 after the ball striker pad 26 has engaged and launched the ball B. Inward ends of the sub-frame 20 are pivotably mounted to the main frame 12 by a cross rod 23 that is mounted by brackets or directly to the main frame 12 and defines the axis X. As illustrated, it is preferred that the axis X be substantially horizontal and spaced elevationally above the base support 18 by a sufficient distance which, in conjunction with the length of the sub-frame 20, allows use of the apparatus for volleyball practice.

The sub-frame 20 freely pivots about the axis X unless otherwise confined by provision of the angle adjuster 28. The angle adjuster 28 (FIGS. 4, 7) may assume other forms, but is illustrated simply as one or more adjustment arms that are pivotably mounted to the main frame 12 and include a number of adjustment stops 30 such as spaced pin receiving holes that permit selective angular positioning of the sub-frame 20 about axis X. Such angular adjustment permits selective positioning of the ball carrier 22 at different desired release points as suggested by solid and dashed lines in FIG. 7. The various adjustments shown are exemplary only and others could be used as well. However, it is of interest to note that the angle may be below the horizontal, or beyond the vertical. Thus, the apparatus may be used for lofting a ball nearly vertically into the air, or forcefully launching the ball in a downward trajectory.

The ball carrier 22 is mounted, in preferred forms, at the outward ends of the sub-frame 20. The exemplary carrier 22 is formed in a hoop configuration that is adjustably mounted between the arms of the sub-frame 20. The hoop may provide an internal releasable ball engaging surface that is shaped to support a ball within the hoop at any angular position. Thus, even with the ball carrier 22 in the over-vertical orientation shown in FIG. 7, the ball will be releasably held and will not drop out of the carrier.

The carrier may be formed of numerous materials but is preferably plastic and the releasable ball engaging surface may be a rubber or other elastomeric substance (see FIG. 8) that will yieldably support the ball within the confines of the carrier. It is noted, however, that a circular hoop need not be used. Equivalent structure including opposed gripping devices or fingers could be used as well. It is even possible that a single suction cup could be used as an equivalent structure, though the hoop configuration as exemplified herein is preferred.

It is advantageous in certain circumstances to provide adjustment capability to the carrier 22. This may be accomplished using a pivot connection as illustrated in FIG. 8 between the carrier and the sub-frame 20. Conventional bolts and wing-nuts may be used for this purpose as illustrated in FIG. 8. The wing nuts, when loosened, function as an adjustment, allowing angular positioning of the tubular sleeve carrier on the sub-frame 20 about an axis that is offset from but substantially parallel to the axis X. Such adjustment can be used to produce backspin or forward spin on a ball secured by the carrier. It is preferable that the adjustment for the carrier be along an axis that will pass substantially through the center of a ball B when the ball is held within the carrier. In this way, the ball will always present a striking surface to the ball striker pad 26 that is substantially centered over the striker pad.

Figure 5:
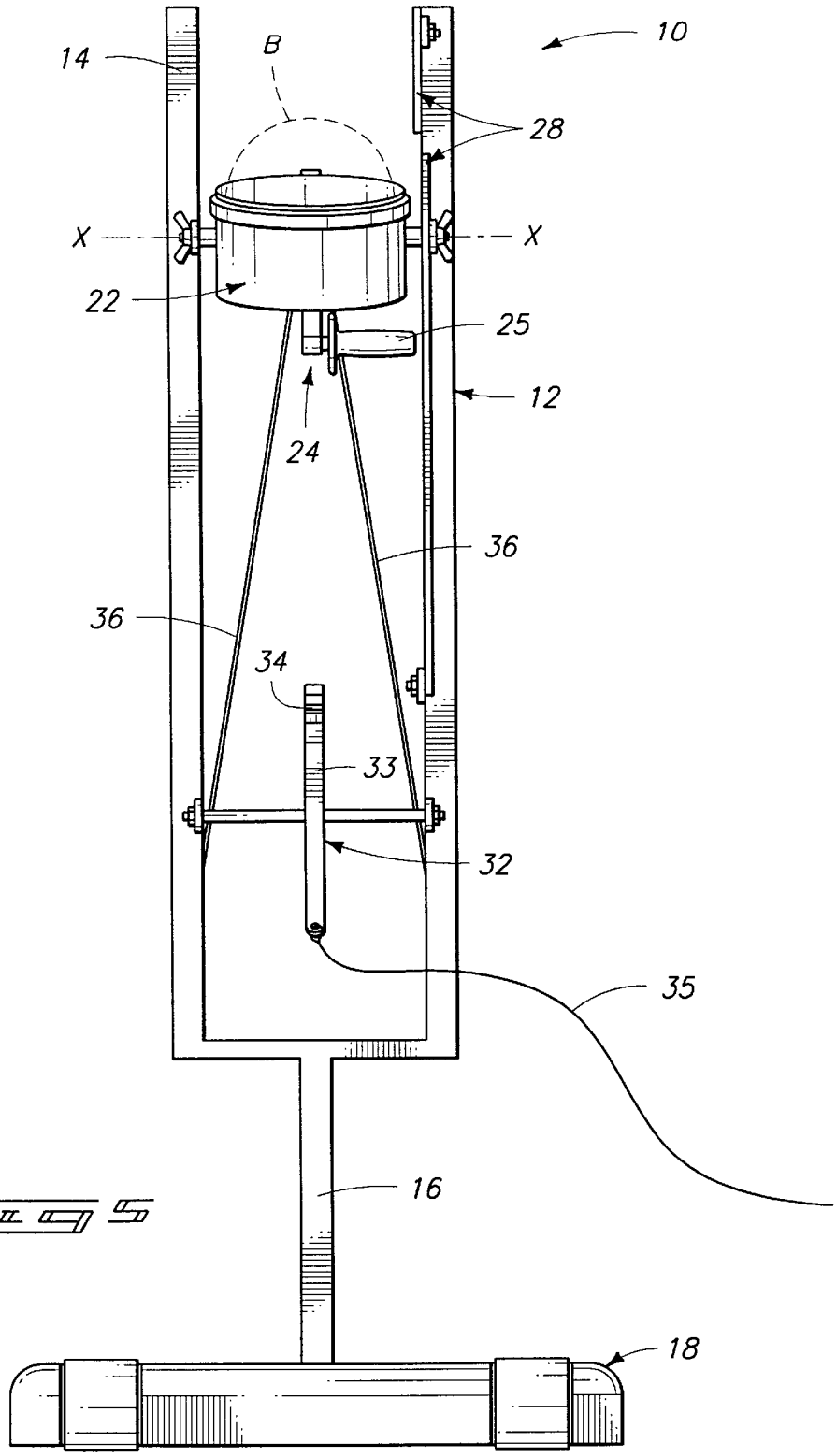
FIG. 5 is a frontal elevation view.

The ball striker arm 24 as shown by example in the drawings, may be formed as a rigid elongated arm that is mounted to the sub-frame for pivotal movement about the axis X. In the illustrated example, the arm 24 is mounted to the pivot shaft and pivots coaxially with the axis X, but independently of the sub-frame 20. Thus, the sub-frame can be adjusted to a selected angular position about the axis X, while the ball striker arm 24 may remain in the same swing path about the same axis X. Thus, the user need only adjust the position of the sub-frame 20 to select the trajectory of the ball, and need not make corresponding adjustments of the ball striker arm 24 because both are pivoted on the same axis. A handle 25 (FIG. 5) may be provided adjacent the striker pad 26 to facilitate manual setting or "cocking" of the ball striker arm.

Also in the illustrated example, the ball striker arm 24 extends to opposed sides of the pivot shaft. One end of the ball striker arm mounts the ball striker pad 26. An opposite end 27 projects to another side of the pivot shaft for connection to the biasing means 36. Thus, tension from the biasing means will urge the striker arm to pivot about the axis X toward the ball carrier 22.

The ball striker pad 26 is illustrated simply as a flat plate spaced by a stub shaft from the striker arm. The plate may be formed of metal, plastic or other material, as may be the remaining portions of the striker arm. The plane of the pad may be radial with respect to the axis X so the ball will be engaged in a flush manner without the pad surface causing any desired deflection. However, it is possible to produce backspin or "english" on the ball by appropriately adjusting the ball carrier as previously described.

The lanyard release 32 may simply be comprised of a "mouse trap" type release involving a pivoted catch arm 33 with a socket 34 at one end, and a lanyard 35 at an opposite end. A transverse pivot shaft 37 may be provided to facilitate pivotal motion of the lanyard release about a release axis that is substantially parallel to the axis X. The socket or other appropriate receptacle 34 is provided at the one end to receive the handle end of the ball striker arm 24. Once captured, the striker arm will not swing forwardly until the lanyard release is pivoted in a direction to disengage the striker arm and allow it to swing under force applied by the biasing means 36 toward the ball carrier 22.

Figure 6:
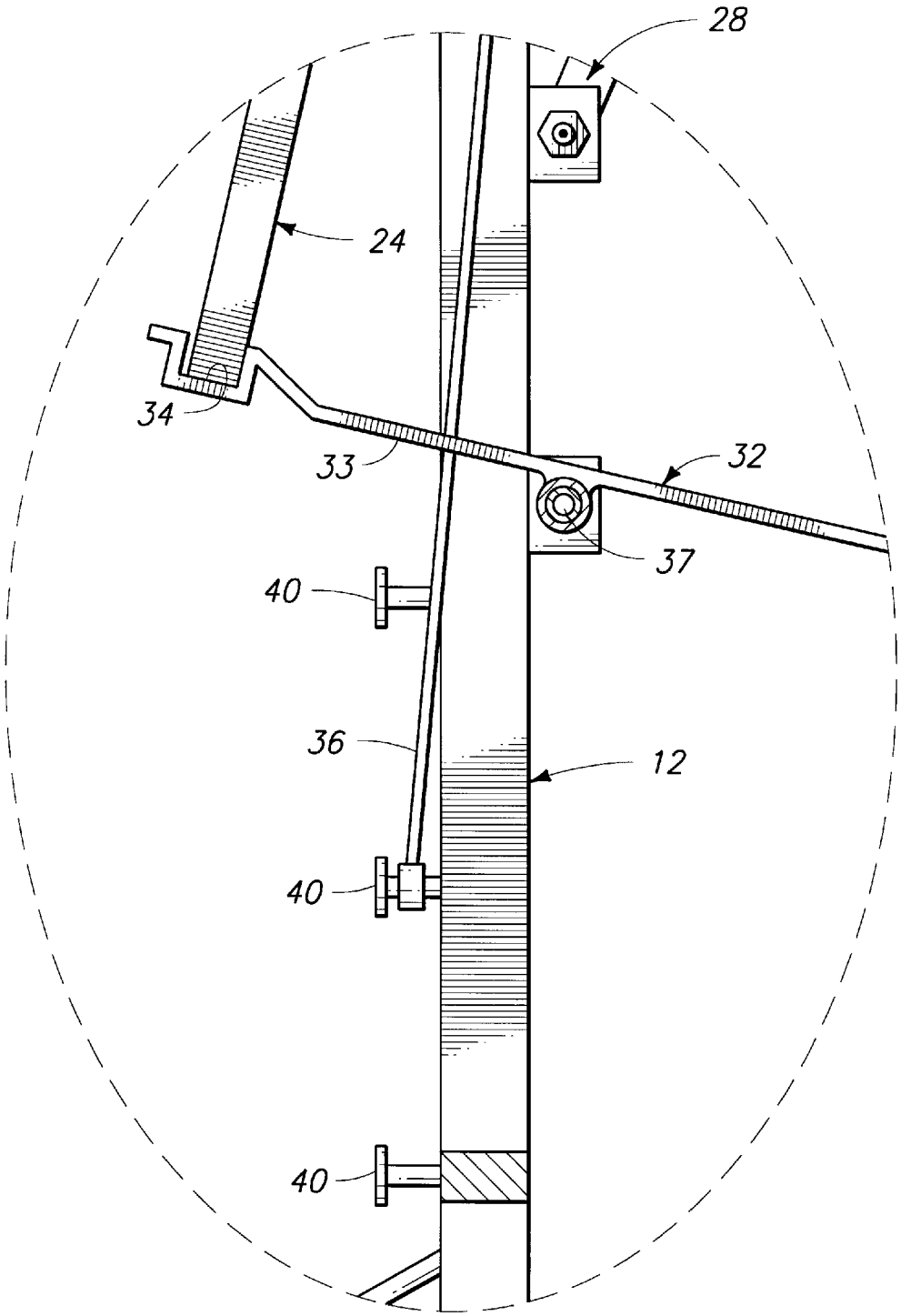
FIG. 6 is an enlarged view of release and tensioning mechanisms.

The socket part provides an inclined ramp that allows the striker arm end to slide into the socket 34 and the forward extent of the catch arm 33, beyond the pivot shaft 37 is provided to overbalance the release so it will naturally return to a ready position after the lanyard has been pulled to pivot the socket 34 downward and disengage the striker arm 24. Details of the lanyard release in a catch or cocked position is shown in FIG. 6.

The biasing means 36 may be any of a variety of springs or equivalent mechanisms that will selectively pivot the ball striker arm 24 forcefully about the axis X to strike a ball held in the carrier 22. In the illustrated example, the biasing means is comprised of an elastic cord that is connected between the main frame 12 and the end 27 of the striker arm 24. A tension adjustment may be provided by way of spaced pins 40 or another appropriate adjustment mechanism along the main frame 12 that facilitate different positioning of the elastic cord ends. The exemplary pins to enable selective adjustment of the spacing between the cord ends and the mounting point on the striker arm end 27. Thus, in the example shown, the upper pins 40 will minimize tension along the cord and a resultant reduction in the force will be transmitted to the striker arm. Conversely, while the lower pins increase the tension and striking force.

Operation of the exemplary apparatus may be understood from the foregoing description and attached drawings. Basically, according to the form of game practice, the user may adjust the sub-frame 20 (see FIG. 7 examples) to determine the angle of ball release, then set the tension for the biasing means to determine the trajectory and distance of ball travel.

In an example such as illustrated in FIG. 1, the apparatus may be considered to have been adjusted to "set" a volleyball for a player to practice spiking the ball over a net. The user simply places a ball in the carrier 22, cocks the striker arm 24 by pivoting it downwardly until the outward end engages and catches the lanyard release 32. The user then may step away to a remote position and pull the lanyard 35.

The release will pivot downward and disengage the striker arm 24, allowing the biasing means to swing the arm forcefully toward the carrier. The striker pad 26 will strike the ball and launch it according to the adjusted angle of the carrier. The arm will stop abruptly as the arm surface strikes the stop or pad 21 on the sub-frame crossbar. The ball will follow a similar trajectory for each use so the user will have consistency in practice and can practice alone without the aid of another individual.

It is understood that other adjustments may be made to provide release of the ball at other angles, including nearly vertical, or even downward angles. These angular positions are identified by way of example in FIG. 7, it being understood that other angles could be adjustably selected as well.

It should be understood that the above description is exemplary by nature and that equivalent elements and configurations of the apparatus may vary. For example, an equivalent apparatus could be produced on a smaller scale and sized to accommodate soccer balls and ball trajectories common for soccer practice. A larger apparatus could be used for basketball.

In compliance with the statute, the invention has been described in language more or less specific as to structural and methodical features. It is to be understood, however, that the invention is not limited to the specific features shown and described, since the means herein disclosed comprise preferred forms of putting the invention into effect. The invention is, therefore, claimed in any of its forms or modifications within the proper scope of the appended claims appropriately interpreted in accordance with the doctrine of equivalents.

What is claimed is:

1. A ball launching apparatus, comprising:

a main frame including a top end and a bottom end;

a base support on the bottom end of the frame supporting the main frame;

a ball support sub-frame mounted to the main frame for adjustable positioning about an adjustment axis;

a ball carrier on the ball support sub-frame positioned thereon at a radial distance from the adjustment axis;

a ball striker arm mounted for pivotal motion about the axis and movable in a swing path intersecting with the ball carrier;

a ball striker pad on the ball striker arm; and wherein the ball carrier is comprised of a hoop with a releasable ball engaging surface shaped to support a ball in any angular orientation.

2. The ball launching apparatus of claim 1 wherein the ball striker arm and ball carrier are coaxial.

3. The ball launching apparatus of claim 1 further comprising an adjustable biasing means connected between the main frame and ball striker arm for producing selective swing force of the ball striker arm about the axis toward the ball carrier.

4. The ball launching apparatus of claim 1 wherein the ball striker arm is mounted to the ball support sub-frame.

5. The ball launching apparatus of claim 1 further comprising a lanyard release mounted to the main frame and releasably engageable with the ball striker arm to permit remote release of the ball striker arm.

6. The ball launching apparatus of claim 1 further comprising a ball support sub-frame angle adjuster mounted between the main frame and ball support sub frame, with adjustable positioning stops at selected positions about the axis.

7. The ball launching apparatus of claim 1 further comprising a ball support sub-frame angle adjuster mounted between the main frame and ball support sub frame, with adjustable positioning stops at selected positions about the axis from a position in which the ball support sub frame is substantially horizontal.

8. The ball launching apparatus of claim 1 wherein the main frame is upright and elongated to position the ball support sub-frame and ball striker arm at an elevation adapted for volley ball practice.

9. The ball launching apparatus of claim 1 wherein the ball carrier is comprised of a hoop and a hoop adjustment selectively operable to set an angular orientation of the hoop about a hoop adjustment that is offset from the axis.

10. A ball launching apparatus, comprising:

an elongated main frame including a top end and a bottom end;

a base support on the bottom end of the frame supporting the main frame in a substantially upright orientation;

a ball support sub-frame mounted to the main frame adjacent the top end for adjustable positioning about a substantially horizontal axis;

a ball support sub-frame angle adjuster mounted between the main frame and ball support sub frame, with adjustable positioning stops at selected positions about the axis;

a ball carrier on the ball support sub-frame positioned thereon at a radial distance from the axis and shaped to releasably grip a game ball;

a ball striker arm mounted for pivotal motion coaxially with the ball support sub-frame and movable in a swing path intersecting with the ball carrier;

a ball striker pad on the ball striker arm;

a lanyard release mounted to the main frame and releasably engageable with the ball striker arm to permit remote release of the ball striker arm; and biasing means connected between the main frame and ball striker arm for producing selective swing force of the ball striker arm about the axis toward the ball carrier.

11. The ball launching apparatus of claim 10 wherein the lanyard release includes a pivoted arm mounted on the main frame with a notch formed to releasably catch a part of the striker arm at a cocked position thereof.

12. The ball launching apparatus of claim 10 wherein the ball carrier is comprised of a tubular sleeve with a resilient pad positioned therein to engage and compress against a game ball to support the ball within the tubular sleeve and release the ball in response to striking engagement by the striker pad.

13. The ball launching apparatus of claim 10 wherein the ball carrier is comprised of a tubular sleeve mounted to the ball support sub-frame by an adjustment that is offset from and substantially parallel to the axis.

14. The ball launching apparatus of claim 10 wherein the biasing means is comprised of an elongated elastic member attached to the frame and the ball striker arm.

15. The ball launching apparatus of claim 10 wherein the ball support sub-frame and the ball striker arm are both mounted to a pivot shaft that is mounted to the main frame coaxially with said axis.

16. The ball launching apparatus of claim 10 wherein the ball support sub-frame and the ball striker arm are adjustably positionable about the axis to facilitate adjustment of a bail trajectory from substantially vertical trajectory to a substantially downward trajectory.

17. The ball launching apparatus of claim 10 further comprising a stop pad on the ball support sub-frame positioned in the swing path to engage the ball striker arm.

18. A ball launching apparatus, comprising:

a main frame including a top end and a bottom end;

a base support on the bottom end of the frame supporting the main frame;

a ball support sub-frame mounted to the main frame for adjustable positioning about an adjustment axis;

a ball carrier on the ball support sub-frame positioned thereon at a radial distance from the adjustment axis;

a ball striker arm mounted for pivotal motion about the axis and movable in a swing path intersecting with the ball carrier;

a ball striker pad on the ball striker arm; and a lanyard release mounted to the main frame and releasably engageable with the ball striker arm to permit remote release of the ball striker arm.

19. The ball launching apparatus of claim 18 wherein the ball striker arm and ball carrier are coaxial.

20. The ball launching apparatus of claim 18 wherein the ball carrier is comprised of a hoop with a releasable ball engaging surface shaped to support a ball in any angular orientation.

21. The ball launching apparatus of claim 18 further comprising an adjustable biasing means connected between the main frame and ball striker arm for producing selective swing force of the ball striker arm about the axis toward the ball carrier.

22. The ball launching apparatus of claim 18 wherein the ball striker arm is mounted to the bail support sub-frame.

23. The ball launching apparatus of claim 18 wherein the ball carrier is comprised of a hoop and a hoop adjustment selectively operable to set an angular orientation of the hoop about a hoop adjustment that is offset from the axis.

24. The ball launching apparatus of claim 18 further comprising a ball support sub-frame angle adjuster mounted between the main frame and ball support sub frame, with adjustable positioning stops at selected positions about the axis.

25. The ball launching apparatus of claim 18 further comprising a ball support sub-frame angle adjuster mounted between the main frame and ball support sub frame, with adjustable positioning stops at selected positions about the axis from a position in which the ball support sub frame is substantially horizontal.

26. The ball launching apparatus of claim 18 wherein the main frame is upright and elongated to position the ball support sub-frame and ball striker arm at an elevation adapted for volley ball practice.

27. A ball launching apparatus, comprising:

a main frame including a top end and a bottom end;

a base support on the bottom end of the frame supporting the main frame;

a ball support sub-frame mounted to the main frame for adjustable positioning about an adjustment axis;

a ball carrier on the ball support sub-frame positioned thereon at a radial distance from the adjustment axis;

a ball striker arm mounted for pivotal motion about the axis and movable in a swing path intersecting with the ball carrier;

a ball striker pad on the ball striker arm; and wherein the ball carrier is comprised of a hoop and a hoop adjustment selectively operable to set an angular orientation of the hoop about a hoop adjustment that is offset from the axis.

* * * * *

UNITED STATES PATENT AND TRADEMARK OFFICE

CERTIFICATE OF CORRECTION

PATENT NO. : 6,546,923 B2
DATED : April 15, 2003
INVENTOR(S) : Erven D. Erickson It is certified that error appears in the above-identified patent and that said Letters Patent is hereby corrected as shown below:

Column 1,
Line 19, please replace "activities for the "setter".A player can set" with
-- activities for the "setter". A player can set --

Column 7,
Line 10, please replace "to facilitate adjustment of a bail" with
-- to facilitate adjustment of a ball --

Column 8,
Line 2, please replace "ball striker arm is mounted to the bail support" with
-- ball striker arm is mounted to the ball support --

Signed and Sealed this

First Day of July, 2003

JAMES E. ROGAN
*Director of the United States Patent and Trademark Office*